US011118363B1

(12) United States Patent
Allen et al.

(10) Patent No.: US 11,118,363 B1
(45) Date of Patent: Sep. 14, 2021

(54) SADDLE TIE-BACK FALL PROTECTION ANCHOR

(71) Applicants: Darrell Allen, Agoura Hills, CA (US); Gary Hardy, Santa Barbara, CA (US)

(72) Inventors: Darrell Allen, Agoura Hills, CA (US); Gary Hardy, Santa Barbara, CA (US)

( * ) Notice: Subject to any disclaimer, the term of this patent is extended or adjusted under 35 U.S.C. 154(b) by 0 days.

(21) Appl. No.: 17/131,380

(22) Filed: Dec. 22, 2020

Related U.S. Application Data

(60) Provisional application No. 62/989,410, filed on Mar. 13, 2020.

(51) Int. Cl.
*E04G 21/32* (2006.01)
*A62B 35/00* (2006.01)

(52) U.S. Cl.
CPC ..... *E04G 21/3276* (2013.01); *A62B 35/0068* (2013.01); *E04G 21/3219* (2013.01)

(58) Field of Classification Search
CPC combination set(s) only.
See application file for complete search history.

(56) References Cited

U.S. PATENT DOCUMENTS

| | | | | |
|---|---|---|---|---|
| 484,617 | A | | 12/1899 | Smith |
| 598,734 | A | | 12/1899 | Markie |
| 1,062,017 | A | | 5/1913 | Larson |
| 1,162,017 | A | | 11/1915 | Barrett |
| 1,466,881 | A | | 9/1923 | Johnson |
| 2,003,100 | A | | 5/1935 | Arpin |
| 2,016,121 | A | | 10/1935 | Rowe |
| 3,217,833 | A | * | 11/1965 | Smith ..... E04G 21/3276 182/3 |
| 3,262,018 | A | | 7/1966 | Bogaerts |
| 3,425,509 | A | | 2/1969 | Allen |
| 3,521,537 | A | | 7/1970 | Fomi |
| 3,669,480 | A | | 6/1972 | Fugate |
| 3,863,899 | A | | 2/1975 | Werner |
| 3,880,405 | A | | 4/1975 | Brueske |
| 3,995,833 | A | | 12/1976 | McLaughlin et al. |
| 4,015,827 | A | | 4/1977 | Brand |
| 4,037,824 | A | | 7/1977 | Whitmer |
| 4,129,197 | A | | 12/1978 | Preston |
| 4,171,032 | A | | 10/1979 | Woolslayer et al. |
| 4,480,819 | A | | 11/1984 | Lopez |

(Continued)

FOREIGN PATENT DOCUMENTS

| | | |
|---|---|---|
| EP | 2447549 A1 | 5/2012 |
| GB | 2127887 A | 4/1984 |
| JP | 11140836 | 4/1984 |

*Primary Examiner* — Monica E Millner
(74) *Attorney, Agent, or Firm* — Cislo & Thomas, LLP

(57) ABSTRACT

A rooftop fall protection anchor that comprises a plate, an anchor connection coupled with a first side of the plate, and at least one member on a second side of the plate, the member being substantially perpendicular and proximate to the plate's edge, configured to attach to a single framing member. The plate and/or member(s) may have holes to accommodate fasteners. The anchor connection may have at least one opening to attach a connection device of a personal fall arrest system (PFAS). The anchor connection may be coupled to the plate by a post. The fall protection anchor may be part of a system that comprises perpendicular blocking, construction strapping, and roof sheathing, either alone or in combination.

18 Claims, 14 Drawing Sheets

(56) References Cited

U.S. PATENT DOCUMENTS

| | | | | |
|---|---|---|---|---|
| 4,520,898 | A | 6/1985 | Allemane | |
| 4,606,430 | A * | 8/1986 | Roby | A62B 35/04 182/3 |
| 4,607,724 | A | 8/1986 | Hillberg | |
| 4,616,734 | A | 10/1986 | Phelps et al. | |
| 4,809,468 | A | 3/1989 | Bareiss | |
| 4,830,341 | A | 5/1989 | Arteau | |
| 4,893,736 | A | 1/1990 | Naig | |
| 4,932,185 | A | 6/1990 | Lebel | |
| 4,996,484 | A | 2/1991 | Spies | |
| 4,998,484 | A | 3/1991 | Groetzinger | |
| 5,011,106 | A | 4/1991 | Cody | |
| 5,054,576 | A | 10/1991 | Glynn | |
| 5,143,170 | A | 9/1992 | Hunt | |
| 5,248,021 | A | 9/1993 | Nichols | |
| 5,282,597 | A | 2/1994 | Babcock | |
| 5,287,944 | A | 2/1994 | Woodyard | |
| 5,320,193 | A | 6/1994 | Bongiovanni et al. | |
| 5,346,036 | A | 9/1994 | Arisman et al. | |
| 5,398,777 | A | 3/1995 | Ouellette et al. | |
| 5,454,197 | A | 10/1995 | Horrigan | |
| 5,465,533 | A | 11/1995 | Rummo, Jr. et al. | |
| 5,553,685 | A | 9/1996 | Cook | |
| 5,727,646 | A | 3/1998 | Gray | |
| 5,730,245 | A | 3/1998 | Conway | |
| 5,730,407 | A | 3/1998 | Ostrobrod | |
| 5,829,203 | A | 11/1998 | Ealer, Sr. | |
| 5,850,889 | A | 12/1998 | Rexroad et al. | |
| 5,941,024 | A | 8/1999 | Journault | |
| 5,971,668 | A | 10/1999 | Miller | |
| 6,015,139 | A | 1/2000 | Weber | |
| 6,173,809 | B1 | 1/2001 | Cole et al. | |
| 6,253,875 | B1 | 7/2001 | Trindade et al. | |
| 6,520,290 | B1 | 2/2003 | Carter | |
| 6,640,495 | B1 | 11/2003 | McKernan | |
| D484,617 | S | 12/2003 | Micheals | |
| 6,668,509 | B1 | 12/2003 | Krebs | |
| 6,672,020 | B1 | 1/2004 | Cermola et al. | |
| 6,691,826 | B1 | 2/2004 | Dean | |
| 6,729,063 | B1 | 5/2004 | Soyko | |
| 6,786,020 | B2 | 9/2004 | Poldmaa | |
| 6,840,015 | B1 | 1/2005 | Ashley | |
| 6,868,647 | B2 | 3/2005 | Poldmaa | |
| 6,908,075 | B1 | 6/2005 | Nichols | |
| 6,966,531 | B2 | 11/2005 | Curtin | |
| 7,048,090 | B2 | 5/2006 | Dean et al. | |
| 7,063,186 | B1 | 6/2006 | Granke | |
| 7,163,083 | B2 | 1/2007 | Argoud | |
| 7,207,414 | B2 | 4/2007 | Luke et al. | |
| 7,360,627 | B2 | 4/2008 | Scott | |
| 7,377,491 | B2 | 5/2008 | Fuoco | |
| 7,380,373 | B2 | 6/2008 | Crookston | |
| 7,528,690 | B2 | 5/2009 | Christmann et al. | |
| D596,734 | S | 8/2009 | Miranda et al. | |
| 7,802,773 | B2 | 9/2010 | Murphy | |
| 7,832,153 | B2 | 11/2010 | Crookston | |
| 7,861,485 | B1 | 1/2011 | Wentworth et al. | |
| 8,025,125 | B2 | 9/2011 | Vetesnik et al. | |
| 8,028,477 | B2 | 10/2011 | Crookston | |
| 8,056,237 | B1 | 11/2011 | Candler et al. | |
| 8,132,792 | B2 | 3/2012 | Perris | |
| 8,448,745 | B2 | 5/2013 | Crookston | |
| 8,448,923 | B1 | 5/2013 | Schad et al. | |
| 8,517,144 | B2 | 8/2013 | Cuccurullo et al. | |
| 9,145,705 | B2 | 9/2015 | Herman | |
| 9,371,666 | B2 * | 6/2016 | Allen | E04H 17/1447 |
| 10,053,878 | B2 | 8/2018 | Allen et al. | |
| 10,415,261 | B2 | 9/2019 | Allen et al. | |
| 10,487,511 | B2 * | 11/2019 | Lallier | E04D 15/00 |
| 2001/0032435 | A1 | 10/2001 | Austin | |
| 2002/0079164 | A1 | 6/2002 | Choate | |
| 2002/0100636 | A1 | 8/2002 | Cole | |
| 2002/0124786 | A1 | 9/2002 | Perkins | |
| 2002/0139063 | A1 | 10/2002 | Crane | |
| 2003/0006094 | A1 | 1/2003 | Cole | |
| 2003/0015696 | A1 | 1/2003 | Watson | |
| 2003/0051429 | A1 | 3/2003 | Hovenier | |
| 2004/0010993 | A1 | 1/2004 | Meadowcroft | |
| 2004/0020713 | A1 | 2/2004 | Fregosi | |
| 2004/0041141 | A1 | 3/2004 | Cannon | |
| 2004/0154241 | A1 | 8/2004 | Joyce et al. | |
| 2004/0173405 | A1 | 9/2004 | Bove | |
| 2004/0195041 | A1 | 10/2004 | Vetesnik | |
| 2004/0256176 | A1 | 12/2004 | Argoud | |
| 2005/0006634 | A1 | 1/2005 | Cuccurullo | |
| 2005/0098381 | A1 | 5/2005 | Flaherty | |
| 2005/0189171 | A1 | 9/2005 | Bos | |
| 2006/0145131 | A1 | 7/2006 | Purvis | |
| 2006/0156645 | A1 | 7/2006 | Munday et al. | |
| 2006/0289233 | A1 | 12/2006 | Flaherty | |
| 2008/0110117 | A1 | 5/2008 | OGorman | |
| 2010/0031573 | A1 | 2/2010 | Whiting et al. | |
| 2010/0032235 | A1 | 2/2010 | Barendregt | |
| 2010/0147624 | A1 | 6/2010 | Caylor et al. | |
| 2010/0243837 | A1 | 9/2010 | Cox | |
| 2010/0326769 | A1 | 12/2010 | Cuccurullo et al. | |
| 2011/0083376 | A1 | 4/2011 | Cuccurullo | |
| 2012/0073900 | A1 | 3/2012 | Cruz | |
| 2012/0186906 | A1 | 7/2012 | Chilton | |
| 2012/0216464 | A1 | 8/2012 | Bonapace | |
| 2013/0118093 | A1 * | 5/2013 | Fortin | E04G 21/3276 52/27 |
| 2014/0123568 | A1 | 5/2014 | Nurdogan | |
| 2014/0224579 | A1 | 8/2014 | Balascak | |
| 2014/0339487 | A1 | 11/2014 | Robinson | |
| 2014/0346312 | A1 | 11/2014 | Small | |
| 2014/0373360 | A1 | 12/2014 | Candler et al. | |
| 2015/0075107 | A1 | 3/2015 | Wert et al. | |
| 2015/0107184 | A1 | 4/2015 | Nichols, Jr. | |
| 2015/0121773 | A1 | 5/2015 | Mills et al. | |
| 2015/0275533 | A1 | 10/2015 | Allen et al. | |
| 2016/0059054 | A1 | 3/2016 | Csizmadia | |
| 2017/0361135 | A1 * | 12/2017 | Crookston | A62B 35/0068 |
| 2018/0119439 | A1 | 5/2018 | Allen et al. | |

* cited by examiner

SADDLE TIE-BACK FALL PROTECTION ANCHOR

CROSS-REFERENCE TO RELATED APPLICATION

This patent application claims the benefit of U.S. Provisional Patent Application Ser. No. 62/989,410, entitled "Saddle Tie-Back Fall Protection Anchor," filed Mar. 13, 2020, which application is incorporated in its entirety here by this reference.

TECHNICAL FIELD

The present invention relates to a saddle tie-back rooftop fall protection anchor and, more particularly, to a novel fall protection anchor that can be coupled with a personal fall arrest device at or near the rooftop of a building.

BACKGROUND

Modem safety standards often require workers on rooftops to employ fall protection systems to guard against fall-related injuries and death. For workers on buildings that are under construction, as well as completed buildings, it may be desirable to use a personal fall arrest system ("PFAS"), such as that specified in the United States Code of Federal Regulations (29 C.F.R. § 1926.502(d)). A PFAS typically comprises a body support (safety harness for the worker), an anchor that is securely fastened to the building structure, and a connector between the anchor and the harness. The connector is usually a fabric strap, which in some systems is mounted on a self-retracting reel that can lock if a fall is detected. In other systems the connector may be a shock-absorbing lanyard. The anchor must be securely attached to the building in such a manner that it will withstand the forces of a falling worker. If more than one anchor is placed on a roof, a horizontal lifeline (cable or otherwise) can be attached to or run through one or more anchors, and the connector may be attached to the horizontal lifeline to give the workers more maneuverability along the horizontal lifeline.

Most anchors are geared towards metal-framed buildings, attaching to metal framing members or a concrete deck. In wood-framing applications, the anchors are most often attached to the top of the wooden rooftop sheathing (⅝-inch or 16 mm plywood or the like), or attached to a one or more framing member (a 2× member) through the sheathing. These applications typically rely on the integrity of the sheathing or the multiple framing members. What is needed is a fall protection anchor that can be used on a single timber in wooden framing that is strong enough to withstand the forces required by the regulations, and is made even stronger when part of a system that spreads the load over a number of adjacent framing members.

SUMMARY

Rooftop anchors are often installed to provide workers with fall protection via a personal fall arrest system ("PFAS"). Such anchors can be temporary for use during construction or reroofing, or permanently installed for use when performing rooftop maintenance, inspection and the like. A PFAS connector can be directly connected to an anchor for use around the anchor. Alternatively, a horizontal line (cable, strap, or the like) can be connected to and/or run through two or more anchors, wherein the PFAS connector can be attached to the horizontal line so the worker can operate along the horizontal line for greater mobility. U.S. Pat. Nos. 10,053,878 and 10,358,835, and 10,415,261, incorporated herein by reference, disclose fall protection anchors that attach to multiple framing members, typically to the inside of each of two framing members. What is needed is a fall protection anchor that is attached to a single framing member, to simplify and speed installation, save money, yet have sufficient strength to act as a permanent fall protection anchor for the building.

A fall protection anchor, particularly for use in wood-framed buildings but not limited thereto, is disclosed herein. Preferably, it is attached in a saddle-like configuration to one framing member with fasteners on each side of the framing member, and that primary framing member may then be connected to adjacent framing members to spread the load to those framing members.

In a preferred embodiment, the fall protection anchor comprises a rectangular horizontal plate, an anchor connection comprising a vertical post with a top ring mounted in the top center of the rectangular horizontal plate, and two vertical rectangular plates mounted perpendicular to the bottom of the long edges of that rectangular horizontal plate to form an upside-down U-shape. The horizontal rectangular plates and/or the vertical rectangular plates may have a plurality of holes to accommodate fasteners. The vertical post may be round, square, oval, polygonal, or any other suitable shape.

In a typical installation of the fall protection anchor, the rooftop primary framing member will just accommodate the U-shaped structure formed by the vertical plates. The framing member may be an increased thickness relative to the adjacent framing members to increase the strength of the anchor and provide the fasteners with sufficient material to penetrate. For example, double or triple thickness framing may be used as the primary framing member to support the anchor. In addition, blocking may be extended on either side of the fall protection anchor to spread the load to adjacent framing, and construction strapping may be added to the blocking. Fasteners, such as nails, bolts, lag screws, or other heavy duty screws may be used to fasten the horizontal and/or vertical plates to the framing. Roofing materials may then be applied to seal the vertical post and prevent water penetration.

The protection anchor may be compliant with appropriate regulations such as OSHA 1926:502 (1995), ANSI Z359.1-07 (2007), ANSI 2359.1-07 (2014), or other applicable regulations, as well as safety standards such as ANSI/International Window Cleaning Association (IWCA) I-14.1-2001, Window Cleaning Safety Section 9.1. Typically, a fall protection anchor must be able to withstand a 5,000 pound (2,268 kg) tensile load, to provide adequate protection during a fall. The fall protection anchor disclosed herein has undergone testing, and meets the minimum standards required for fall protection anchors.

Accordingly, it is an object of the present invention to provide an improved fall protection anchor. Other and further objects and advantages will appear hereinafter.

DETAILED DESCRIPTION OF THE INVENTION

Figure 1:
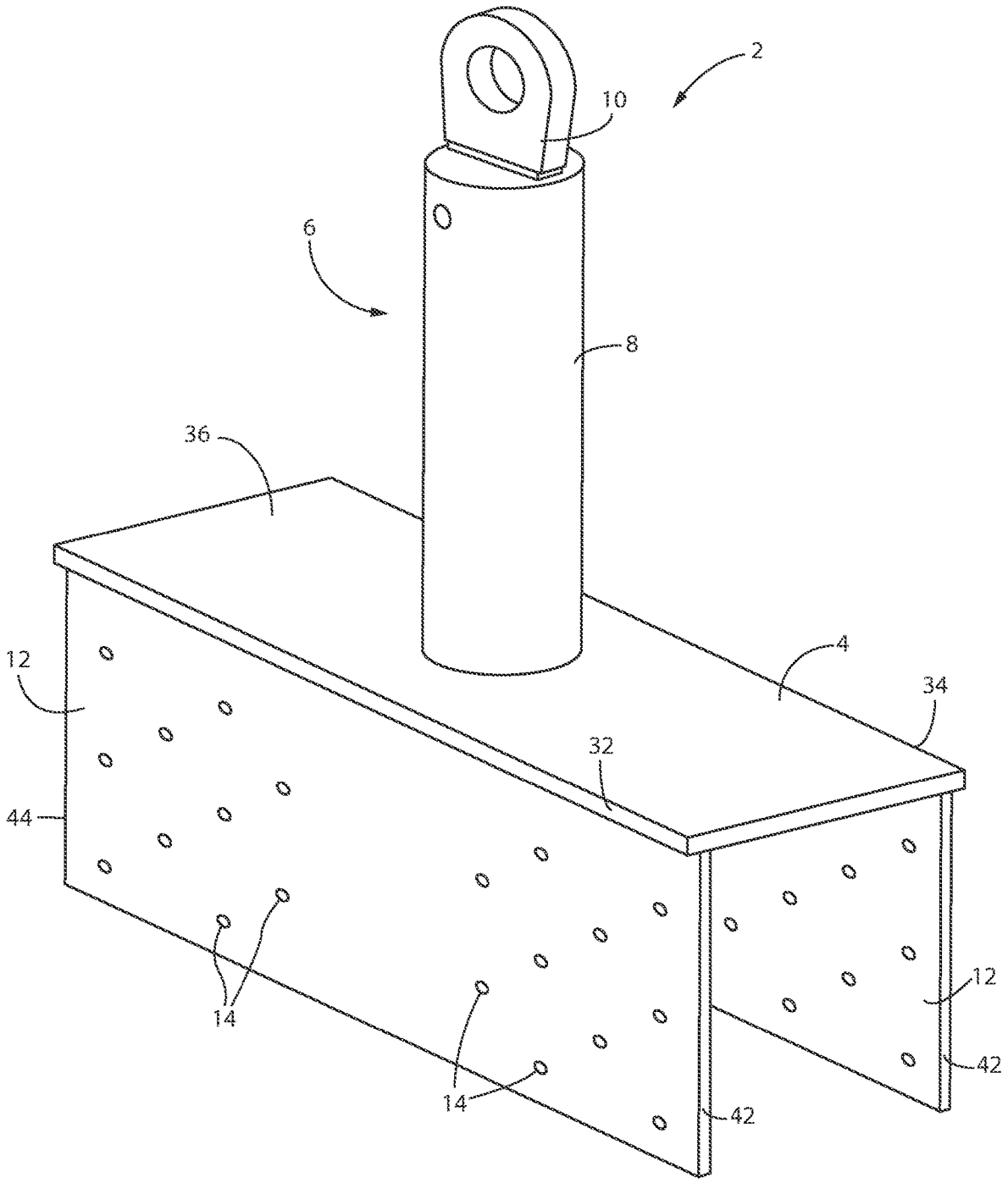
FIG. 1 depicts a perspective view of the present invention.
Figure 2:
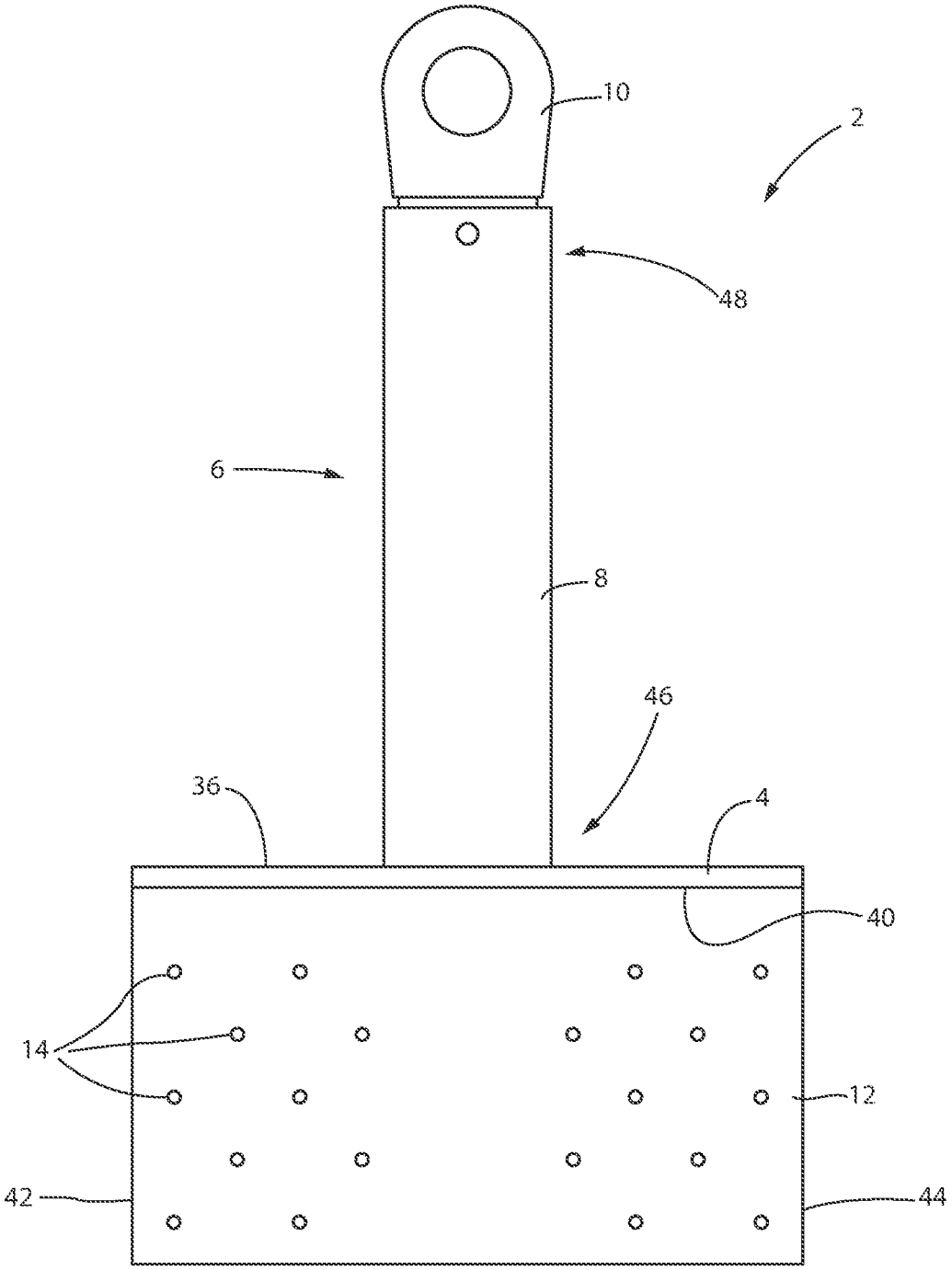
FIG. 2 depicts a side view of the present invention.
Figure 3:
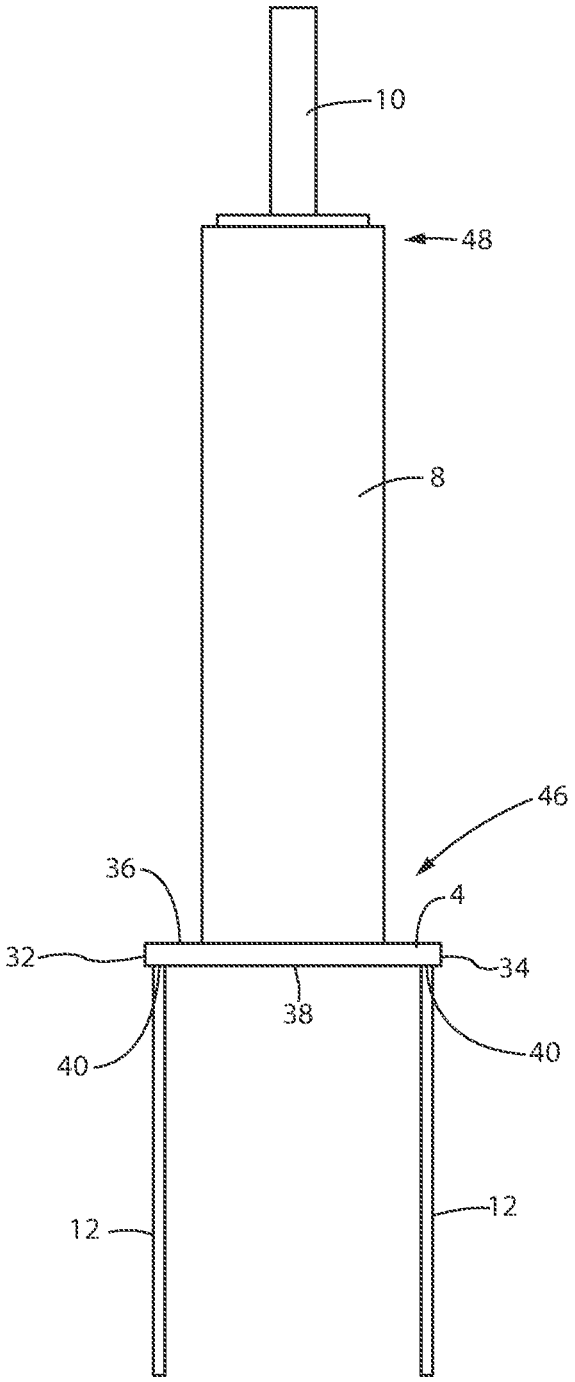
FIG. 3 depicts an end view of the present invention.
Figure 4:
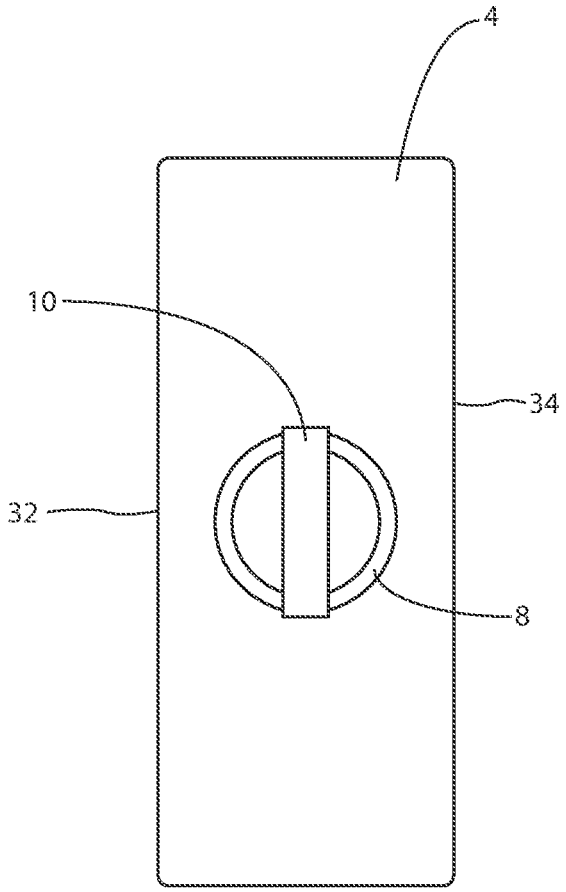
FIG. 4 depicts a top view of the present invention.
Figure 5:
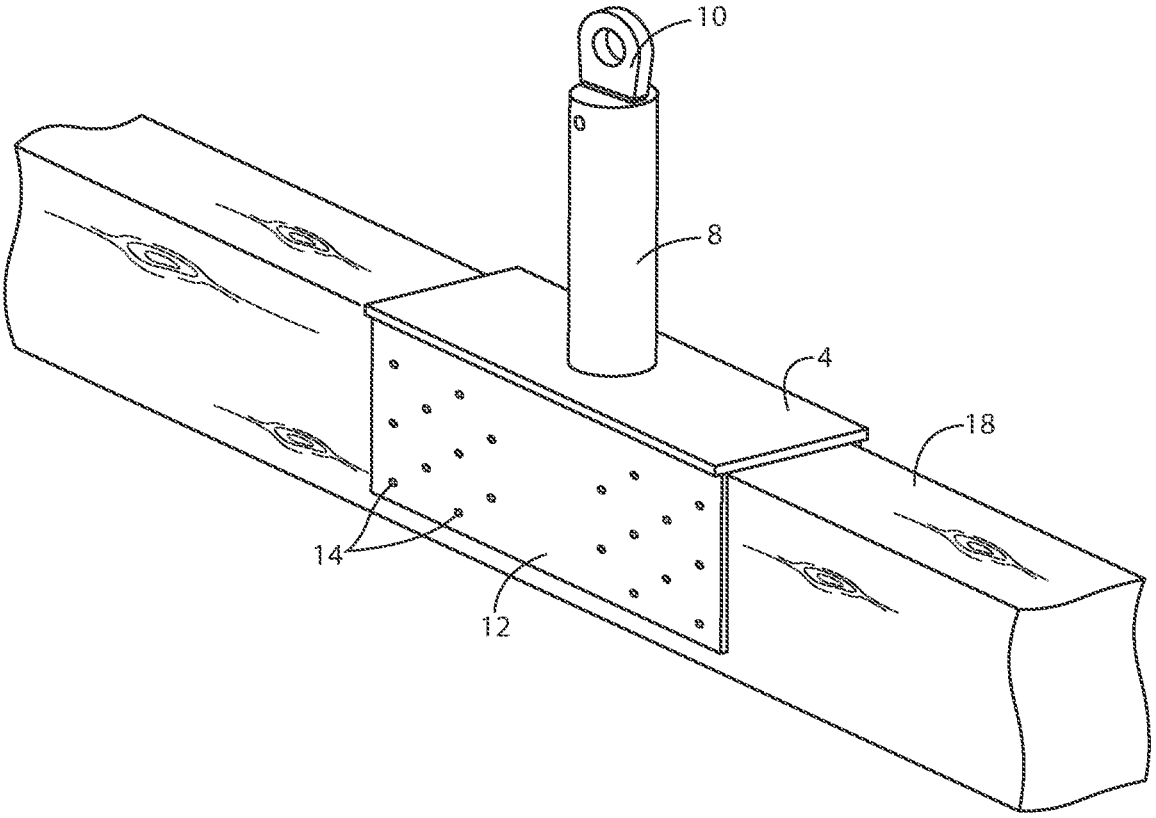
FIG. 5 depicts a perspective view of the present invention placed on a typical framing member.
Figure 6:
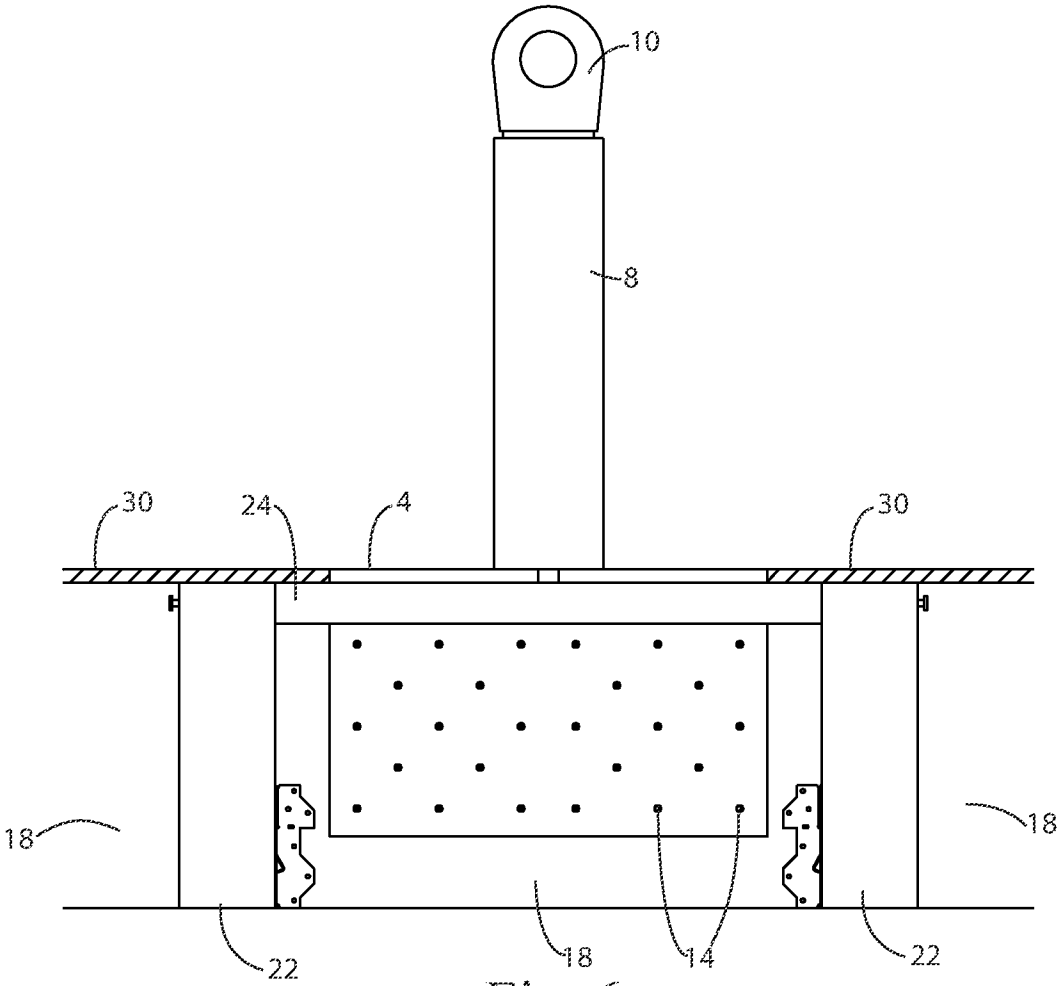
FIG. 6 depicts a side view of the present invention placed onto a typical framing member.
Figure 7:
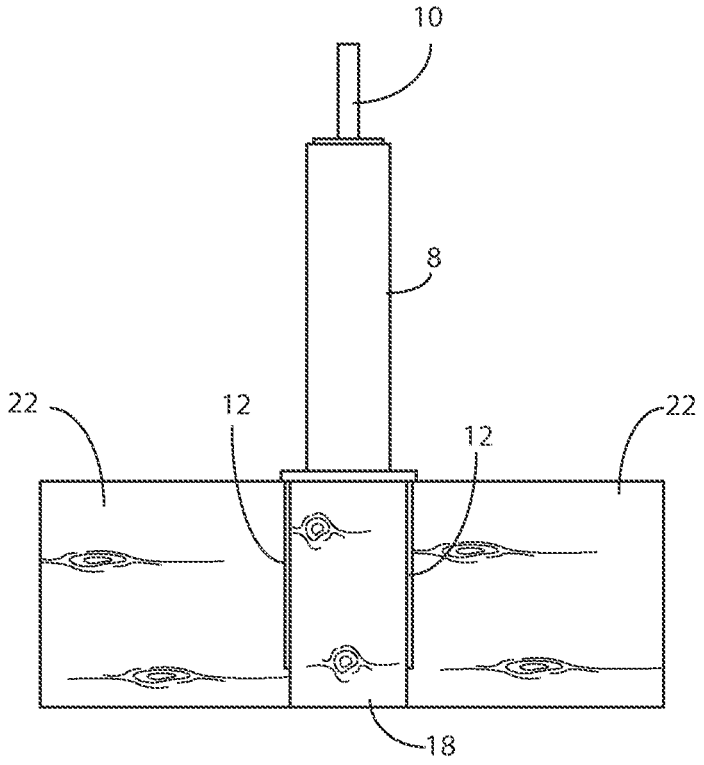
FIG. 7 depicts an end view of the present invention placed onto a typical framing member.
Figure 8:
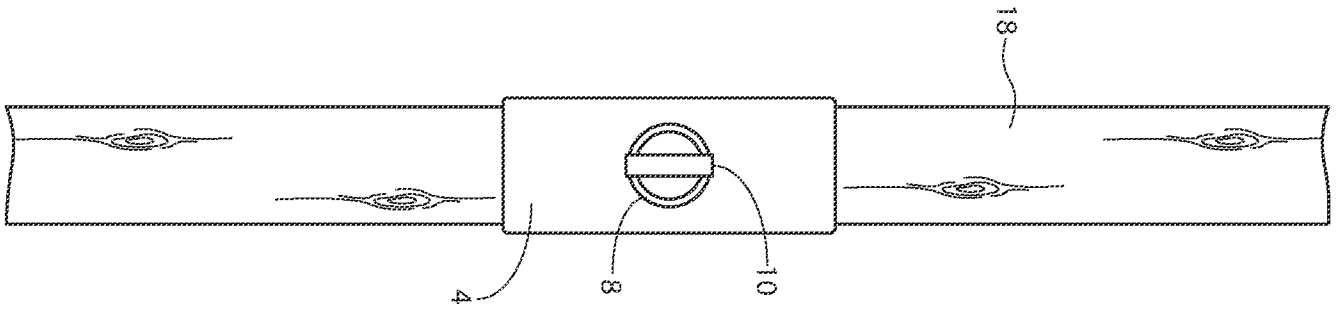
FIG. 8 depicts a top view of the present invention placed onto a typical framing member.

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

Rooftop safety anchors are typically used to protect rooftop workers from falls, used as part of a support or suspension system, or may be as an auxiliary fall protection independent of such systems. A PFAS typically comprises a body support (safety harness for the worker), an anchor that is securely fastened to the building structure, and a connector between the anchor and the harness. The present invention focuses on the anchor.

The fall protection anchor 2 disclosed herein may be used for support, suspension, or fall protection. FIGS. 1-4 show that the fall protection anchor 2 may include a horizontal plate 4, which is preferably square or rectangular to correspond to typical building framing. The horizontal plate 4 has a top (first) 36 surface and a bottom (second) surface 38. Coupled with the top surface 36 of the horizontal plate 4, preferably near the middle, is the anchor connection 6, which may comprise a post 8 and/or a connection attachment 10. If a post 8 is used, the post's bottom end 46 is preferably mounted perpendicular to the top of the horizontal plate 4, and may be any suitable length. The post 8 may have a first end 46 and a second end 48, and may be hollow or solid, and may have any suitable cross section, including but not limited to square, round, oval, or polygonal, and may be constructed of any suitable material that has sufficient strength and durability to survive the elements. In a preferred embodiment, the post 8 may be a cylindrical pipe with a 4-inch outer diameter and a 3.5-inch inner diameter, although other diameters and thicknesses may be used. In an alternative preferred embodiment, the post 8 may be constructed of 3.5 inch (90 mm) square steel tubing with 0.375 inch (10 mm) wall thickness. The post 8 may be coupled with the horizontal plate 4 in any suitable manner, but the preferred attachment method is welding. The preferred material for the post 8 is steel and its alloys, either stainless steel or non-stainless steel preferably coated with anti-corrosion material such as zinc, galvanizing, coatings, or the like. Preferably, if non-stainless steel is used for the horizontal plate 4 and the post 8 and/or connection attachment 10, after the post 8 and/or connection attachment 10 is welded to the horizontal plate 4, the entire assembly or portions of the assembly may be given anti-corrosion treatment.

As shown in FIGS. 1-4, the horizontal plate 4 may comprise a rectangular plate comprising a first long edge 32, a second long edge 34, two short edges, a first surface 36, and a second surface 38 opposite the first surface, the four edges defining a perimeter of the rectangular plate. The anchor connection 6 may comprise a post 8 comprising a first end 46 and a second end 48, the first end coupled with the first surface 36 of the rectangular plate and located substantially centrally thereon, the second end 48 having a connection attachment 10, and the post 8 oriented substantially perpendicular to the rectangular plate. The vertical members 12 may comprise a first member and a second member, each member being substantially planar and rectangular with a long edge 40, wherein the first member is substantially perpendicularly to the rectangular plate and the long edge of the first member is coupled with the second surface of the rectangular plate proximate and parallel to the first long edge of the rectangular plate, wherein the second member is substantially perpendicularly to the rectangular plate and the long edge of the second member is coupled with the second surface of the rectangular plate proximate and parallel to the second long edge of the rectangular plate, and wherein at least one of the first or second members defines an attachment hole configured to accept a fastener. The members 12 may also have a first short edge 42 and a second short edge 44.

One or more holes may be located in the horizontal plate 4 within the interior of the post 8, and/or anywhere along the post 8 to relieve pressure during galvanizing or other anti-corrosion treatments, as well as provide drainage if needed. Upon installation, any holes along the post 8 may be sealed to prevent water infiltration.

The connection attachment 10 may be a ring or eyebolt of a suitable diameter to attach or insert a connection device such as a snaphook, carabiner, cable, horizontal lifeline, webbing, etc. The connection attachment 10 may be used without the post 8, coupled with the horizontal plate 4. The connection attachment 10 could be a structure other than a simple ring, such as a D-ring, swivel, a locking clip, or any other suitable attachment. The connection attachment 10 is preferably made of steel, which may be forged or otherwise strengthened or inherently strong enough to withstand significant forces generated during a fall. Alternatively, the connection attachment 10 may be made of any other suitable material that can withstand such forces. In a preferred embodiment, the connection attachment 10 may comprise a 0.5-inch steel plate placed horizontally across the top of the post 8, and welded or otherwise attached to the post 8, with a 4-inch×4-inch square of steel plate with a 2-inch diameter eyelet, welded or otherwise attached vertically to the horizontal steel plate. This 4×4 steel plate may have its top two corners rounded for safety and/or ease of use, but preferably there will be at least a continuous 1-inch annulus of steel plate material bounded by the rounded top corners. Preferably, the connection attachment 10 will have anti-corrosive properties or an anti-corrosive finish. Preferably, the connection attachment 10 will have a relatively smooth finish to prevent abrasion of the connection device. The connection attachment 10 may be coupled with the horizontal plate 4 or the post 8 by any suitable means, including but not limited to welding, adhesives, threaded connections, etc. If a removable coupling is used, such as a threaded connection, it may include some means of preventing accidental loosening, such as a cotter pin, keyway, thread locking adhesive, split-lock, locking nut, lock washers, or even a weld.

Alternatively, the anchor connection 6 may be coupled with the horizontal plate 4 by the connection attachment 10 comprising an eye bolt or equivalent with a long shank (not shown) that can extend through the post 8 and a small hole (not shown) in the horizontal plate 4, wherein the threads of the shank are secured to the bottom surface of the horizontal plate 4 with a nut or other suitable retention element, or the shank could be welded to the horizontal plate 4.

Coupled to the bottom surface of the horizontal plate 4 is at least one vertical member 12. Preferably, there are two vertical members 12 that are substantially planar and preferably rectangular, and may be coupled along the long bottom edges of the horizontal plate 4 along their length, so that the horizontal plate 4 and the two vertical members 12 form an upside-down U-shape. The vertical members 12 may be constructed of steel, and may be coupled to the horizontal plate 4 by welding, and the vertical members 12 may be inset from the edge of the horizontal plate 4 to facilitate welding. In alternative embodiments, the vertical member(s) 12 may comprise non-planar configurations, such as tubing, bar stock, or the like, and/or non-rectangular configurations of any suitable shape. Alternatively, the horizontal plate 4 and one or more vertical members 12 may be made of a single piece of metal, either cast, forged, or bent into shape. Alternatively, the horizontal plate 4 and one or more vertical members 12 may be some combination of cast, forged, or bent metal, as well as welded pieces.

The preferred dimensions for the fall protection anchor 2 components are a 0.5 inch thick horizontal plate 4 that is 6.5 inches wide and 16 inches long, vertical members 12 that are 0.25 inches thick, 7 to 9 inches tall, and 16 inches long, and a post 8 that is between 12 and 36 inches long, 4.0 inches in exterior diameter with a wall thickness of 0.25 inches. The distance between the two vertical members 12 is preferably 5.625 inches, to accommodate standard 6× dimensional lumber that has a nominal width of 5.50 inches. The thicknesses and dimensions of the plate/members/post may be thicker or thinner than disclosed, and the thickness ratio between the horizontal plate 4 and the vertical member(s) 12 of may be different as well. Suitable materials other than steel may also be used for their construction. In some embodiments, any number of vertical members 12 may be used.

As shown in FIGS. 1-10, the fall protection anchor 2 may be designed to fit like a saddle over a roofing framing member, with about an ⅛ (0.125) inch of play. For purposes of discussion, the framing member to which the fall protection anchor is attached will be referred to as the "primary framing member 18." Alternatively, the primary framing member 18 could be two, three, or four times the thickness as the other roofing framing members, and the fall protection anchor 2 may be a suitable dimension to accommodate the primary framing member 18. Alternatively, the roof could be framed with joists 20 of conventional size, and a separate primary framing member 18 of suitable thickness may be installed between the existing roofing joists 20. Preferably, the primary framing member will be a standard "6×" timber, such as a 6×8 or 6×10 or 6×12, which has a nominal thickness of 5.5 inches, although other dimensional lumber may be used.

As shown in FIGS. 1-2, 5 and 6, in a preferred embodiment, the vertical members 12 may be equipped with attachment holes 14 to accommodate fasteners 16. In addition, the horizontal plate 4 may also be equipped with such attachment holes (not shown). The fasteners 16 are typically driven through the attachment holes 14 and into the primary framing member 18, and the head of the fastener holds the plates securely to the primary framing member 18. The fasteners 16 may be nails, screws, bolts and nuts, lag screws, or other suitable fasteners 16 for attaching structural steel to wooden or steel framing. If screws are used in wood framing, they may be heavy-duty construction screws, such as Simpson SDS, USP WS, or the like. Preferably, the fasteners 16 will be of sufficient length so that when placed in the vertical members 12 they will penetrate any sistered timbers of the primary framing member 18, discussed below. Alternatively, the fasteners 16 may only need to be long enough and/or thick enough to provide the necessary strength for the application.

The attachment holes 14 accommodate fasteners 16 to resist shear and tension uplift. These components working together allow the fall protection anchor 2 to minimize movement at the connection attachment 10 atop the post 8. The connection attachment 10 should have sufficient tensile and shear strength to resist a load of at least 5000 lbs. applied at any angle to the connection attachment 10, as required by 29 C.F.R. Section 1926.502(d), as well as other applicable regulations.

In a preferred embodiment, the attachment holes 14 in each of the vertical members 12 may be arranged in five vertical rows per vertical member 12, or as shown in the Figures. In a preferred embodiment, a vertical member 12 is comprised of 0.25-inch steel plate, 9 inches by 16 inches. Preferably, there may be twenty attachment holes 14 in each vertical member 12, with the attachment holes 14 spaced 1.0 inch from the bottom and sides of the vertical member 12, and 2.0 inches from the top. Preferably, the attachment holes 14 are in two sets of ten, in five horizontal rows, each horizontal row being 1.5 inches apart, and the two holes in each row being 3.0 inches apart, with the holes in each successive row being staggered 1.5 inches horizontally from the holes in the adjacent rows. Each set of ten is spaced 1.0 inch from their respective side of the vertical member 12, resulting in a 5.0-inch width in the middle of the vertical member 12 without any attachment holes 14. Alternatively, the holes in the vertical members 12 may be arranged in other manners, such as a singular or repeating "W" or "X" pattern, or in other patterns, preferably so that the fasteners 16 from one vertical member 12 will not interfere with the fasteners 16 of the other vertical member 12. The fasteners 16 may have a shank thickness that is approximately 0.25 inches (6 mm) to fit within the holes. More or less attachment holes 14 and fasteners 16 may be used, and the attachment holes 14 and fasteners 16 may be larger or smaller. The number of fasteners 16 and their spacing distributes the load.

In addition to or in lieu of the above-described attachment holes 14, larger attachment holes (not shown) may be provided to accommodate large through bolts as fasteners 16. In a preferred embodiment, two such larger attachment holes may be on each vertical member 12 located 1.5 inches above the bottom and 3 inches from the vertical side of each vertical member 12, with matching holes in the corresponding vertical member 12, although other locations may be used. These larger attachment holes may be 15/16 (0.9375) inches in diameter, to accommodate a ⅞ (0.875) inch bolt fastener. Such bolts may be placed through the long timbers of the framing, for a total of two bolts per fall protection anchor 2, although bolts may also or alternatively be used in the blocking 22. Such bolts may be secured with suitable nuts and washers. In alternative embodiments, there may be more or less larger attachment holes and corresponding bolt fasteners 16, and the positions of the attachment holes may vary.

Although the preferred embodiment includes multiple attachment holes 14 in the vertical members 12, alternative embodiments may have holes in the horizontal plate 4, or fewer or even no attachment holes 14 in the horizontal plate 4 or the vertical members 12. For example, it may be sufficient to use only one fastener 16 (or multiple fasteners) in each vertical member 12, and no fasteners 16 in the horizontal plate 4. Alternatively, it may be sufficient to use only a few fasteners 16 in the horizontal plate 4 and no fasteners 16 in the vertical members 12. Although testing (discussed below), results in a structure that did not fail under mandated loads, further testing may show that fewer or no fasteners 16 in these structures may still provide the required strength. Testing may further show that blocking 22 is not required for the requisite strength.

The fall protection anchor 2 may also be installed as part of a system, as shown in FIGS. 9-13. In a typical installation, the roof framing is constructed of long horizontal timbers (joists, rafters, purlins, etc.—collectively "joists 20") in at least one direction, with typical dimensional lumber such as 2×8, 2×10, 2×12, etc. or the metric equivalent. The primary framing member 18 may be a typical roof joist, a roof joist to which additional lumber is sistered to achieve a greater thickness, or a timber that is independent of the standard roof joists 20.

Figure 9:
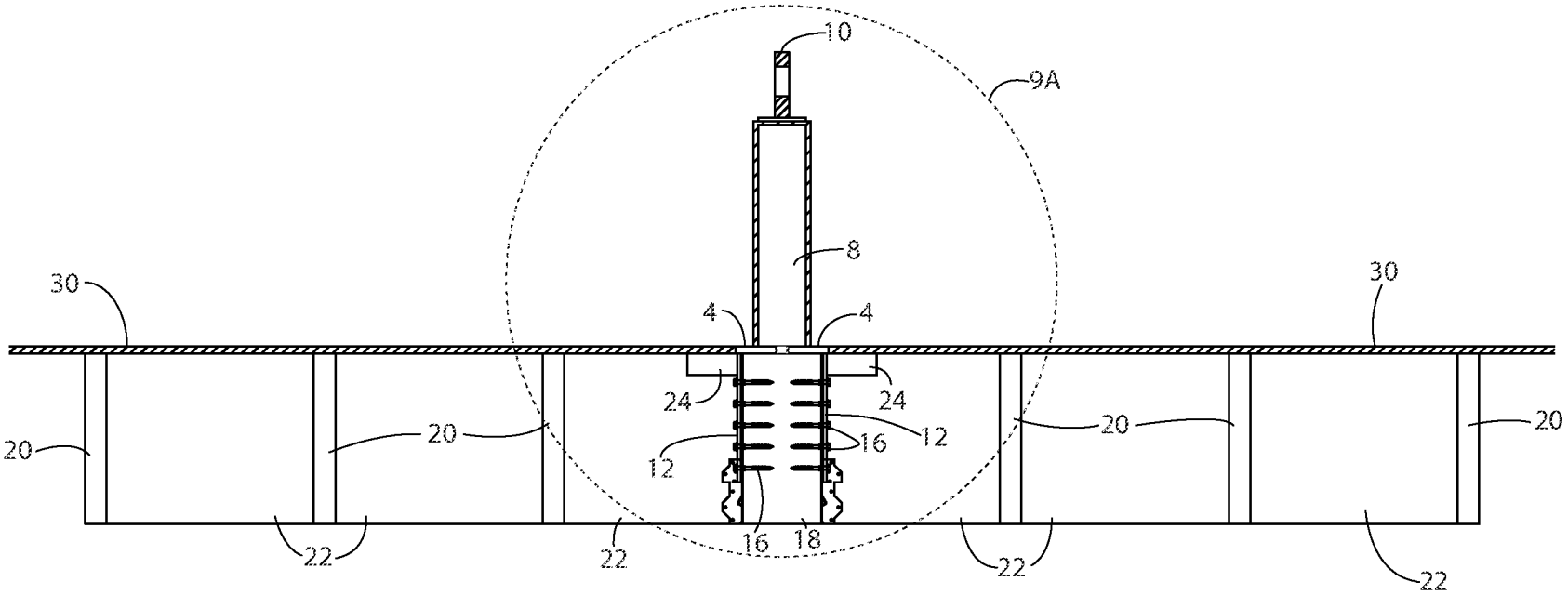
FIG. 9 depicts an end view of the present invention installed in a typical roof structure.
Figure 9A:
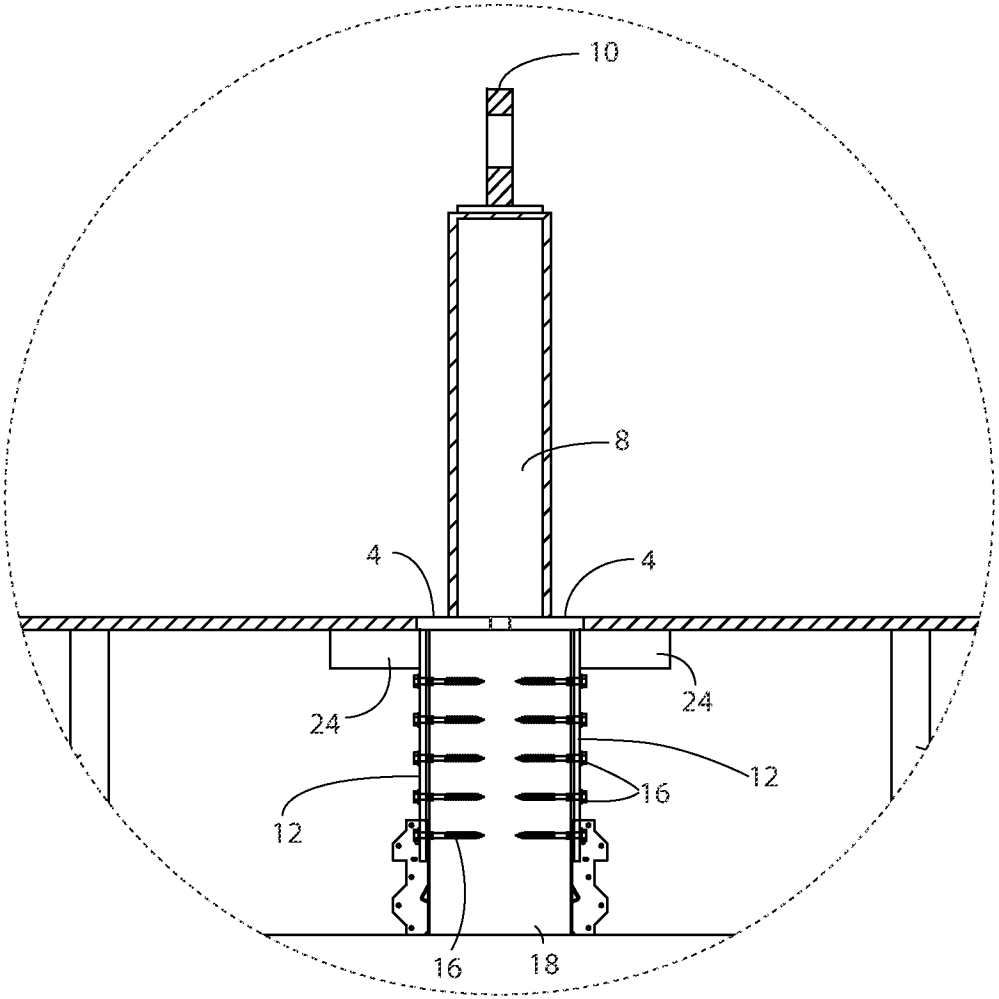
FIG. 9A is an enlarged view of a portion of FIG. 9.
Figure 10:
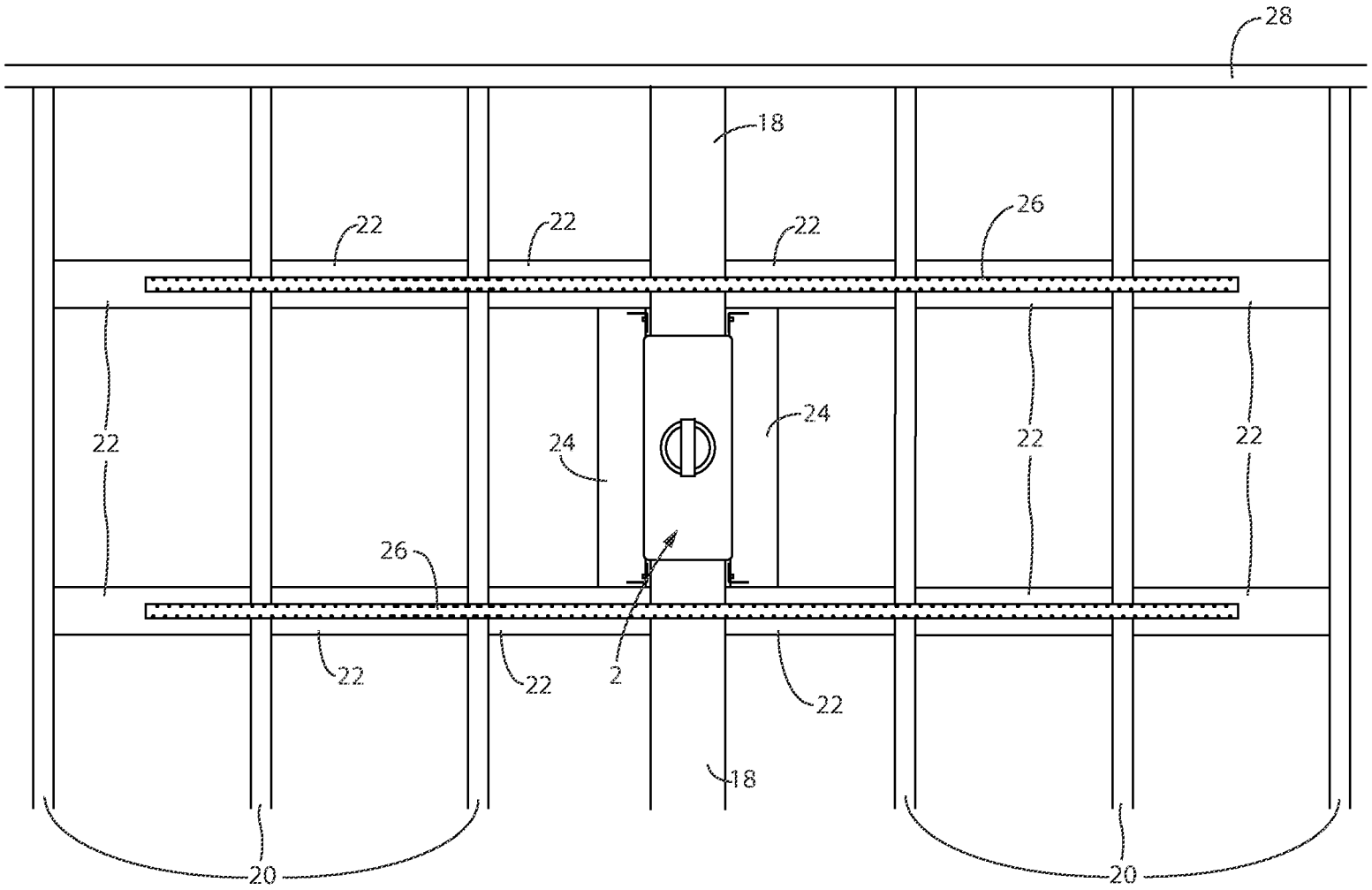
FIG. 10 depicts a plan view of the present invention installed in a typical roof structure.

Preferably, the primary framing member 18 will be a full-length 6×10 timber, with nominal dimensions of 5.5 inches by 9.5 inches. In a preferred embodiment of the system, the primary framing member 18 will be used in place of a joist, installed in the same location as the typical joists, as shown in FIGS. 9 and 10.

Alternatively, an engineered wood product ("EWP") beam may be used as the primary framing member, such as VERSA-LAM by Boise Cascade or similar. Such products often have a 5.25 inch thickness. To fit the standard size fall protection anchor, a filler 25 (not shown) comprised of a 0.375-inch (⅜ inch) plywood may be used on one side, fastened in place prior to placing the fall protection anchor 2. Extra length fasteners 16 may be used on the filler side to sufficiently penetrate the EWP beam through the filler.

Figure 11:
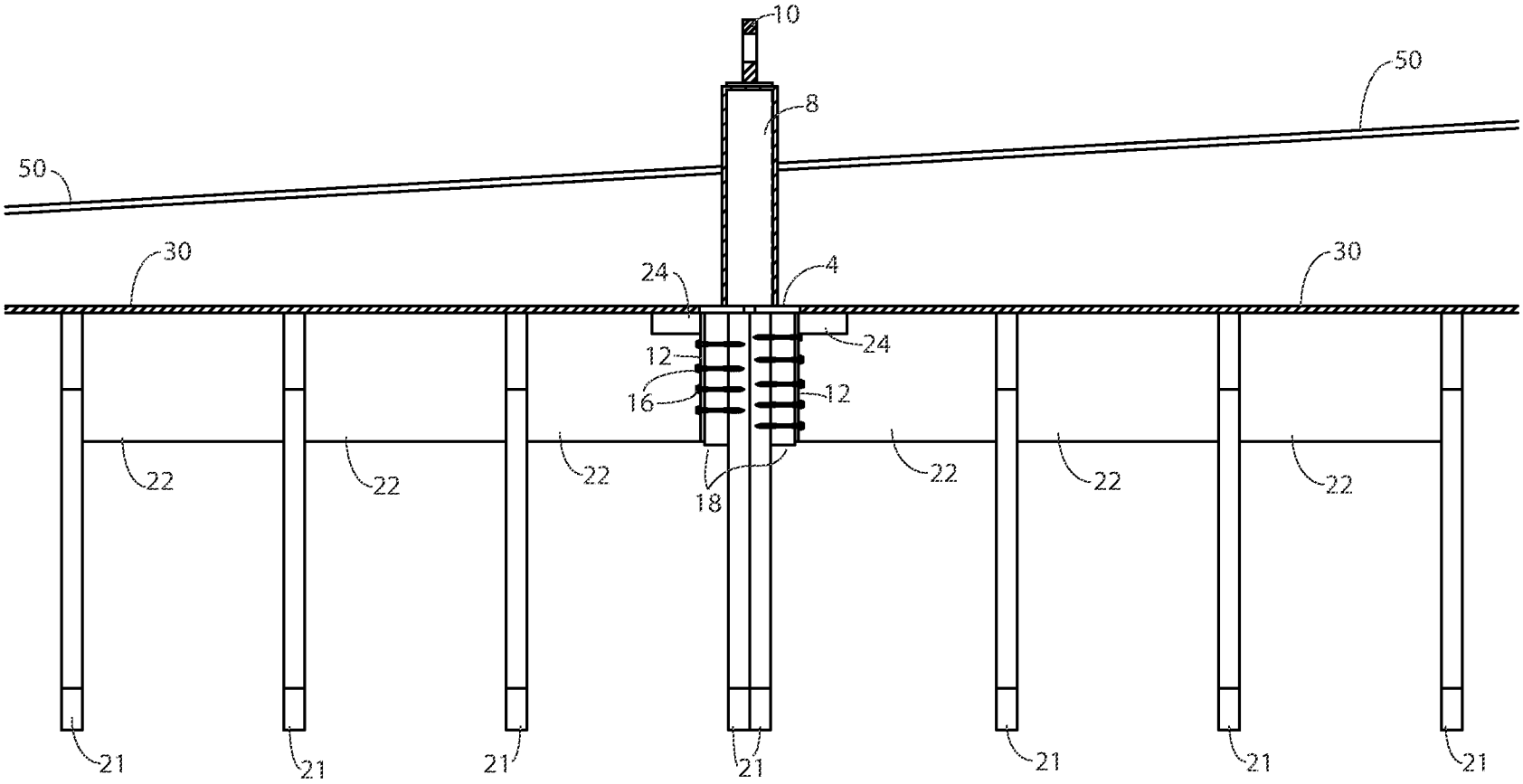
FIG. 11 depicts an cross-section end view of the present invention installed on a roof structure that uses trusses.
Figure 12:
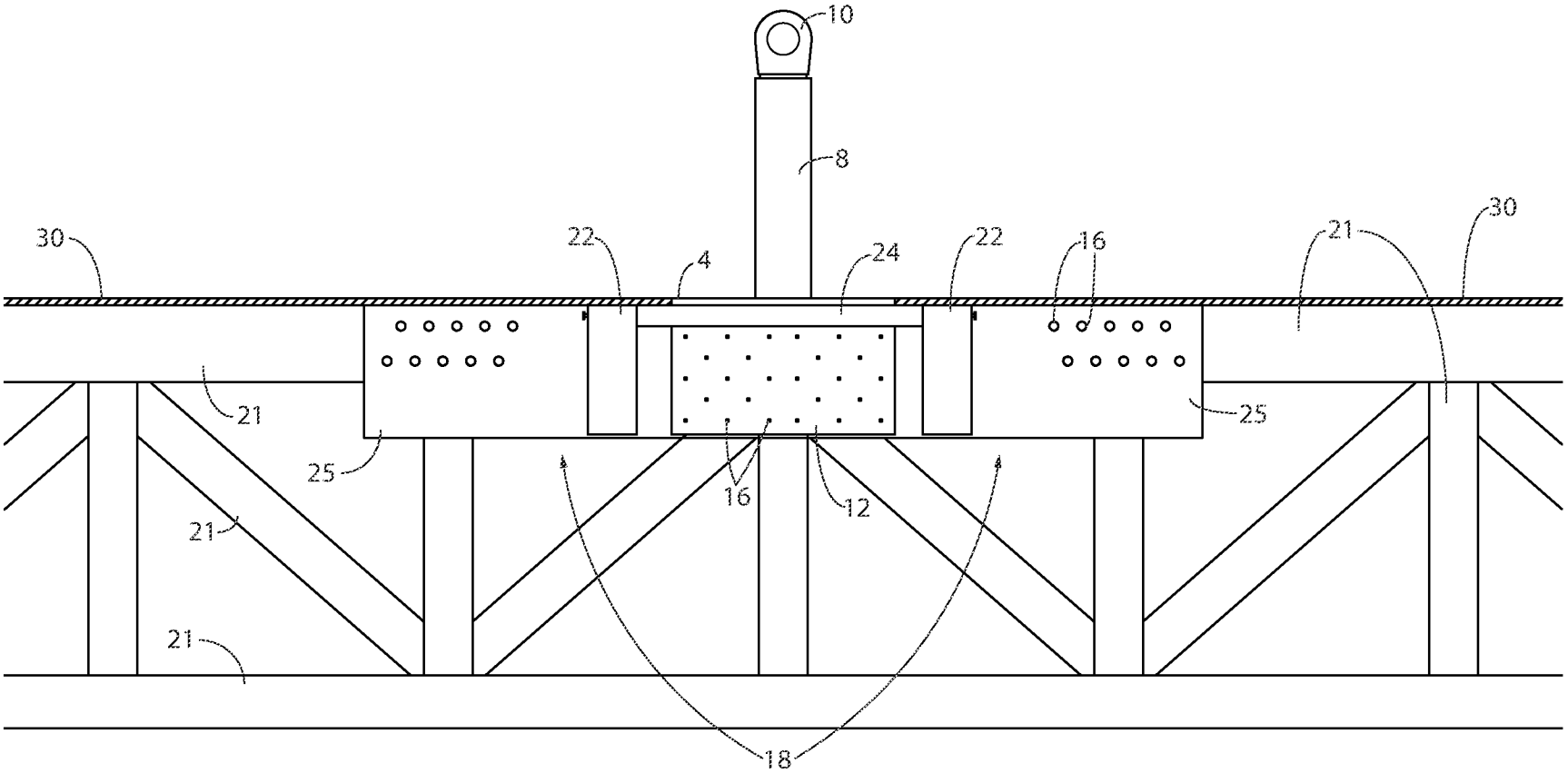
FIG. 12 depicts a side view of the present invention installed on a roof structure that uses trusses.
Figure 13:
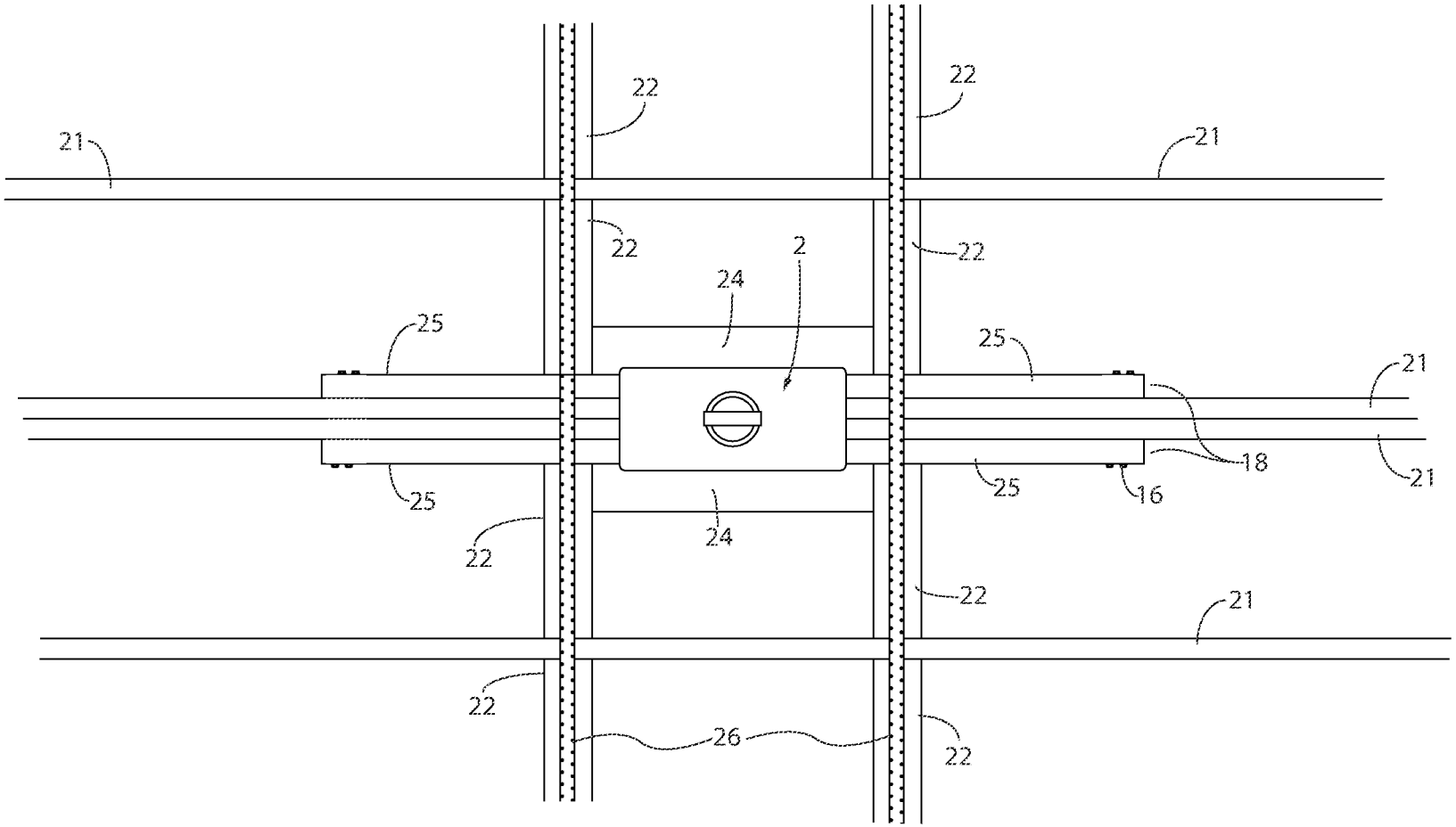
FIG. 13 depicts a plan view of the present invention installed on a roof structure that uses trusses.

To install the fall protection anchor 2 on trusses 21, preferably two trusses 21 will be sistered together as shown in FIGS. 11-13. Preferably, a filler 25 comprised of an EWP beam 1.75 inches×9.5 inches and a sufficiently length (typically determined by the engineer of record for the project) is sistered to at least one side of the sistered trusses (preferably both sides), and the filler(s) 25 may be attached by fasteners 16 at each end of their length. Products other than EWP may be used as fillers 25. The fall protection anchor 2 is then placed over the truss/filler assembly that comprises the primary framing member 18, and fasteners 16 are used to attach the fall protection anchor 2 to the truss/filler assembly/primary framing member 18, preferably with fasteners 16 that are long enough to penetrate at least one of the trusses.

For any of the above-described installations, sloped roof framing 50 may be installed in lieu of or over the roof sheathing 30, as shown in FIG. 11. In such case, the post 8 will penetrate the sloped roof framing 50 and any roofing membrane, and may be sealed with typical methods. Alternatively, the connection attachment 10 may be set below the sloped roof framing 50, in a hatch with a weather cover over the hatch (not shown).

Preferably, the fall protection anchor 2 system may also comprise perpendicular blockings 22 placed as shown in FIGS. 7-13, with blocking 22 between the primary framing member 18 to which the fall protection anchor 2 is attached and several adjacent joists 20. Such blocking may be the same dimensional lumber as the roof joists 20, although it could be smaller or larger lumber, or any material that could be used in place of lumber, such as metal framing or any other suitable material. In addition, flat blocks may be placed flush and tight against the saddle itself, between the other blockings 22, as shown in FIGS. 9-13. The blockings 22 attached to the primary framing member 18 are preferably placed proximate to the first short edge 42 and the second short edge 44 of the first member 12 and second member 12, with enough room between those short edges 42, 44 to nail or place connecting hardware for the blocking 22. In addition, the connections between the joists 20 and the blocking 22 may be strengthened by using strapping 26. The additional blocking 22 for the fall protection anchor 2 distributes the load to the roof joists 20 that are adjacent to the primary framing member 18 on which the fall protection anchor 2 is installed. Alternatively, such blocking 22 may be omitted, or fewer blockings used.

Alternatively, double thickness timber for the primary framing member 18 and/or blocking 22 may be used (4×8, 4×10, 4×12, etc.). The double thickness may provide added strength to the installation, although in some applications a double thickness of long timber and/or blocking 22 may not be required to achieve the necessary strength. In a preferred embodiment, the blocking will be 4×10 dimensional lumber, with nominal dimensions of 3.5×9.5 inches. The blocking 22 may be installed with typical framing fasteners such as nails or screws, although specialized construction fasteners may be used, as well as brackets or hangers such as A35 by Simpson or others suitable for the task. The primary framing member 18 for the fall protection anchor 2 may be atop or adjacent to a wall on the floor below, to provide additional support for the framing supporting the fall protection anchor 2. Preferably the fasteners 16 will penetrate at least 35 percent of the total thickness of the primary framing member 18 and/or blocking 22, although more or less penetration could be used, including 100 percent penetration for through-bolt fasteners 16. Preferably, for a primary framing member 18 that is a 6×10, the fasteners may be 2.5 inches long. Alternatively, triple or quadruple thickness primary framing member 18 and/or blocking 22 may be used (6×8, 6×10, 6×12, etc. or 8×8, 8×10, 8×12, etc.).

As noted above, the primary framing member 18 used for the fall protection anchor 2 may be a larger timber laid in between the standard roof joists 20, connected to the rim joists 28, and then blocked into adjacent roof joists 20. Alternatively, the primary framing member 18 used for the fall protection anchor 2 system may be blocked into the adjacent roof joists 20 for a sufficient distance that connecting the primary framing member 18 to the rim joists 28 is not required.

If the primary framing member 18 on which the fall protection anchor 2 is placed has an increased thickness over the adjacent roof joists or trusses, the increased thickness may be continued for approximately 72 inches (1830 mm) or other suitable distance, but preferably the entire length of the primary framing member 18. The extra thickness is preferably made of one piece of dimensional stock, rather than sistering smaller stock together to achieve the thickness, but sistering may be used as well, particularly where the extra thickness does not extend the entire length of the primary framing member 18. Likewise, the blocking 22 and/or double blocking 22 may be continued onto nearby framing such as roof joists 20, which should provide additional strength to the installation by spreading the load among more framing members. Preferably, the blocking 22 may extend to three bays of roof joists 20 on each side of the primary framing member 18, as shown in FIGS. 9-11.

As shown in FIGS. 10 and 13, construction strapping 26 (Simpson CS/CMST or the like) may be installed with appropriate fasteners, which may also add strength to the blocking 22 and the overall installation. The strapping 26 may be installed above and/or below the blocking 22, atop or under the roof sheathing 30. Where construction strapping 26 is installed above the roof sheathing 30, fasteners 16 may be driven through strapping 26, the roof sheathing 30, and into the blocking 22, along the length of the blocking 22. Preferably the construction strapping 26 may be used across the roof joists 20 along the length of all the blocking 22 and extend to the ends of all blocking 22, but shorter or longer lengths may be used as appropriate. In some installations, strapping 26 may extend down vertically onto building support posts, where it may also be attached.

If attachment holes 14 and fasteners 16 are used in the horizontal plate 4, the holes in the horizontal plate 4 may be countersunk or otherwise opened to accommodate the head of the fastener, so that the heads are either flush with or protrude minimally above the top surface of the horizontal plate 4, while maintaining sufficient strength of the horizontal plate 4. This will help maintain a relatively smooth surface on the horizontal plate 4 for either the roof sheathing 30 or the roofing membrane.

Because the horizontal plate 4 is preferably installed directly over the primary framing member 18, the roof sheathing 30 may be installed around the horizontal plate 4 as shown in FIGS. 9, 11 and 12. Given that the preferred thickness of the horizontal plate 4 is 0.5 inches, and typical roof sheathing 30 is ⅝ inch (16 mm) or ¾ inch (18 mm) plywood or the like, the horizontal plate 4 2 will be close to flush with the roof sheathing 30. This will ease the installation of the roofing materials. If desired, a thin sheet of plywood, such as % inch (6 mm), could be used to cover the horizontal plate 4 and aide the smooth transition for the roofing material, while covering the heads of any fasteners 16.

Alternatively, the horizontal plate 4 may be installed above or below the roof sheathing 30. To reduce the stress on roof sheathing 30 or roofing membrane placed atop the right-angle edges of the horizontal plate 4, the edges of the horizontal plate 4 may be rounded or tapered to ease the transition, and may even be extended with a tapering edge. Alternatively, a tapered edge could be installed adjacent to the horizontal plate 4, made of wood, plastic, metal or any other suitable material.

Alternatively, rather than countersinking the holes in the horizontal plate 4, a transition cover (not shown) could be used to cover and/or approximate the height of the heads of the fasteners 16 so that the transition cover provides a generally smooth and substantially continuous surface above the horizontal plate 4 and its fasteners 16, and may also provide an edge transition for the horizontal plate 4. Such a transition cover may allow the horizontal plate 4 to be thinner due to the lack of countersinking, which would reduce cost of the horizontal plate 4 both in material cost (thinner plate is cheaper) and machining cost (for the countersinking). The transition cover could be single or multiple pieces, and used above or below the roof sheathing 30. As a non-limiting example of such a transition cover, if the thickness of the heads of the fasteners 16 and the horizontal plate 4 are both 0.25 inches (6.35 mm), a top cover in the same shape as the horizontal plate 4 could be fashioned from 0.25 inch plywood with holes cut out to accommodate the fastener heads and the post 8. One or more pieces of material that match up to the combined height of the plate and the top cover (0.25+0.25=0.5 inches) could be placed against the edge of the horizontal plate 4 and taper outwardly from the horizontal plate 4.

On a flat roof installation, the anchor connection 6 may penetrate the roofing membrane. The penetration may be sealed by conventional methods, such as flashing, sealants, etc.

Alternatively, the fall protection anchor 2 need not be installed solely on flat rooftops. It may also be employed on the side of a building, on sloped surfaces including but not limited to roofs, or even on ceilings or overhangs. The framing and fasteners 16 must be sufficient to accommodate such placement. For such alternative installations, the construction of the fall protection anchor 2 could be different. For such installations, the "top" and "bottom" surfaces of the horizontal plate 4 would merely refer to opposite sides, and not necessarily the direction the surface is facing.

Three prototypes of the fall protection anchor HTB-S12, HTB-S18, and HTB-S24, were tested by Specialized Testing in Santa Fe Springs, Calif., to make sure they conformed to the regulatory requirements and design parameters. The first prototype device, HTB-S12, consisted of a horizontal plate 4 that was 0.5 inches thick, 6.5 inches wide, and 16 inches long. Each vertical member 12 was 0.25 inches thick, 7.0 inches tall, and 16.0 inches wide, and each had 16 attachment holes 14 to facilitate 0.25-inch×2.5-inch SDS screws in each vertical member 12. The dimensions of the timber to which the prototype was attached was not given, but it appeared to be a 6×10. A 4.0-inch diameter×12-inch long steel tube post 8 was welded to the center of the horizontal plate 4. A 1.0-inch thick forged eye connection attachment 10 was welded to the top of the post 8. The connection attachment 10 was subjected to lateral loads in four directions, and a vertical tension load. The four horizontal loads of 5,000 pounds for five minutes each resulted in a deflection of 0.84 to 1.74 inches. The horizontal tension load of 12,400 pounds for 5 minutes resulted in a deflection of 0.035 inches. After releasing the loads, no visual evidence of failure or permanent deformation of the fall protection anchor 2 were observed.

The second prototype device, HTB-S18, consisted of a horizontal plate 4 that was 0.5 inches thick, 6.5 inches wide, and 16 inches long. Each vertical member 12 was 0.25 inches thick, 7.0 inches tall, and 16.0 inches wide, and each had 16 attachment holes 14 to facilitate 0.25-inch×2.5-inch SDS screws in each vertical member 12. The dimensions of the timber to which the prototype was attached was not given, but it appeared to be a 6×10. A 4.0-inch diameter× 18-inch long steel tube post 8 was welded to the center of the horizontal plate 4. A 1.0-inch thick forged eye connection attachment 10 was welded to the top of the post 8. The connection attachment 10 was subjected to lateral loads in four directions, and a vertical tension load. The four horizontal loads of 5,000 pounds for five minutes each resulted in a deflection of 0.75 to 1.96 inches. The horizontal tension load of 12,400 pounds for 5 minutes resulted in a deflection of 0.020 inches. After releasing the loads, no visual evidence of failure or permanent deformation of the fall protection anchor 2 were observed.

The third prototype device, HTB-24SL, consisted of a horizontal plate 4 that was 0.5 inches thick, 6.5 inches wide, and 16 inches long. Each vertical member 12 was 0.25 inches thick, 9.0 inches tall, and 16.0 inches wide, and each had 22 attachment holes 14 to facilitate 0.25-inch×2.5-inch SDS screws in each vertical member 12. The dimensions of the timber to which the prototype was attached was not given, but it appeared to be a 6×10. A 4.0-inch diameter× 24-inch long steel tube post 8 was welded to the center of the horizontal plate 4. A 1.0-inch thick forged eye connection attachment 10 was welded to the top of the post 8. The connection attachment 10 was subjected to lateral loads in four directions, and a vertical tension load. The four horizontal loads of 5,000 pounds for five minutes each resulted in a deflection of 1.96 to 2.06 inches. The horizontal tension load of 12,400 pounds for 5 minutes resulted in a deflection of 0.069 inches. After releasing the loads, no visual evidence of failure or permanent deformation of the fall protection anchor 2 were observed.

A method of constructing the fall protection anchor 2 disclosed herein may comprise providing a horizontal plate 4 with a top and bottom surface, at least one vertical member 12, and an anchor connection, coupling the anchor connection with the top surface of the horizontal plate 4, and welding at least one vertical member 12 perpendicularly to the bottom surface of the horizontal plate 4, wherein the vertical members 12 and/or horizontal plate 4 have holes to accommodate fasteners 16. An alternative method to forming the horizontal plate 4 and vertical members 12 may comprise bending metal into a desired shape such as the upside-down U-shape, or some combination of bending and welding. Yet another alternative for forming the saddle portion of the device comprise forging the saddle into the desired shape.

A method for installing the fall protection anchor 2 disclosed herein may comprise providing fall protection device comprising a horizontal plate 4 with a top and bottom surface, an anchor connection 6 coupled with the top surface of the horizontal plate 4, and at least one vertical member 12 perpendicularly coupled with the bottom surface of the horizontal plate 4, wherein the horizontal plate 4 and/or vertical member(s) have holes to accommodate fasteners 16, installing fasteners 16 through the holes of the horizontal and/or vertical members 12 and into the primary framing member 18. Reinforcing the primary framing member 18 and spreading the load may comprise installing blocking 22 perpendicular to the primary framing member 18 on either or both sides of the fall protection anchor 2, preferably for three bays on each side of the primary framing member 18 as shown in FIGS. 9-11. Further securing the fall protection anchor 2 may comprise installing flat blocking 24 flush to the vertical members 12, connecting the flat blocking 24 ends to the perpendicular blocking 22. Tying all the blocking 22 together may comprise installing construction strapping 26 (Simpson CS/CMST or the like) atop the blocking 22 for a preferable distance of at least 4 feet on each side of the fall protection anchor 2, nailing the strapping 26 to the blocking 22 along the blocking's length. Further strengthening the assembly may comprise installing roofing sheathing 30 between the blocking 22 and the construction strapping 26. A method of using such an installed fall protection anchor 2 may comprise coupling a connection device to the anchor connection 6, and coupling the connection device to a body support of a worker.

The foregoing fall protection anchor 2 is not limited to installation in wood-framed buildings. The fall protection anchor 2 may be adapted to metal-framed buildings as well. Fasteners 16 would have to be suitable for use on metal framing, or wooden framing would have to be attached to the metal framing to install the fall protection anchor 2 as discussed above.

The foregoing description of the preferred embodiment of the invention has been presented for the purposes of illustration and description. It is not intended to be exhaustive or to limit the invention to the precise form disclosed. Modifications and variations are possible in light of the above teaching. It is intended that the scope of the invention not be limited by this detailed description, but by the claims and the equivalents to the claims appended hereto.

What is claimed is:

1. A fall protection anchor for a wood-framed building, comprising:

a rectangular plate comprising a first long edge, a second long edge opposite the first long edge, a first surface, and a second surface opposite the first surface;

a post comprising a first end and a second end, the first end coupled with the first surface of the rectangular plate and located substantially centrally thereon, the second end having a connection attachment, and the post oriented substantially perpendicular to the rectangular plate;

a first member and a second member, each member being substantially planar and rectangular with a long edge, wherein the first member is substantially perpendicularly to the rectangular plate and the long edge of the first member is coupled with the second surface of the rectangular plate proximate and parallel to the first long edge of the rectangular plate, wherein the second member is substantially perpendicularly to the rectangular plate and the long edge of the second member is coupled with the second surface of the rectangular plate proximate and parallel to the second long edge of the rectangular plate, and wherein at least one of the first or second members defines an attachment hole configured to accept a fastener, wherein a spacing between the first member and second member is configured to fit on a primary framing member of a wood framed building.

2. The fall protection anchor for a wood-framed building of claim 1, wherein the first member and the second member define a plurality of attachment holes.

3. A fall protection anchor system for a wood-framed building, comprising:

a rectangular plate comprising a first long edge, a second long edge opposite the first long edge, a first surface, and a second surface opposite the first surface;

a post comprising a first end and a second end, the first end coupled with the first surface of the rectangular plate and located substantially centrally thereon, the second end having a connection attachment, and the post oriented substantially perpendicular to the rectangular plate;

a first member and a second member, each member being substantially planar and rectangular with a long edge, a first short edge, and a second short edge, wherein the first member is substantially perpendicularly to the rectangular plate and the long edge of the first member is coupled with the second surface of the rectangular plate proximate and parallel to the first long edge of the rectangular plate, wherein the second member is substantially perpendicularly to the rectangular plate and the long edge of the second member is coupled with the second surface of the rectangular plate proximate and parallel to the second long edge of the rectangular plate, and wherein at least one of the first and second members define a plurality of attachment holes, each configured to accept a fastener, and a plurality of fasteners adapted to fit the attachment holes, wherein a spacing between the first member and second member is configured to fit on a primary framing member that acts as a roof joist of a wood framed building.

4. The fall protection anchor system for a wood-framed building of claim 3, wherein the primary framing member has a width that is at least twice that of adjacent roof joists, a length, a first side and a second side opposite the first side.

5. The fall protection anchor system for a wood-framed building of claim 3, wherein the fall protection anchor system is configured for being positioned in between a first blocking, a second blocking, a third blocking and a fourth blocking, wherein the first blocking is perpendicular to and attached to the primary framing member proximate to the first short edge of the first member, the second blocking is perpendicular to and attached to the primary framing member proximate to the second short edge of the first member, wherein the first blocking and second blocking are further attached to a first roof joist that runs parallel to the primary framing member, the third blocking is perpendicular to and attached to the primary framing member proximate to the first short edge of the second member, the fourth blocking is perpendicular to and attached to the primary framing member proximate to the second short edge of the second member, wherein the third blocking and fourth blocking are further attached to a second roof joist that runs parallel to the primary framing member.

6. The fall protection anchor system for a wood-framed building of claim 5 wherein the first blocking and third blocking are collinear and on opposite sides of the primary framing member, and the second blocking and fourth blocking are collinear and on opposite sides of the primary framing member.

7. The fall protection anchor system for a wood-framed building of claim 5, wherein the fall protection anchor system is configured for placement below at least one roof sheathing covering the primary framing member, the first joist, the second Joist, the first blocking, the second blocking, the third blocking, and the fourth blocking, and wherein the first blocking and third blocking are arranged in a straight line on opposite sides of the primary framing member, and the second blocking and fourth blocking are arranged in a straight line on opposite sides of the primary framing member.

8. A method of installing a fall protection anchor system on a wood-framed building, comprising:

providing a fall protection anchor for a wood-framed building, the fall protection anchor comprising:

a rectangular plate comprising a first long edge, a second long edge, two short edges, a first surface, and a second surface opposite the first surface;

a post comprising a first end and a second end, the first end coupled with the first surface of the rectangular plate and located substantially centrally thereon, the second end having a connection attachment, and the post oriented substantially perpendicular to the rectangular plate;

a first member and a second member, each member being substantially planar and rectangular with a long edge, the first member is substantially perpendicularly to the rectangular plate, and the long edge of the first member is coupled with the second surface of the rectangular plate proximate and parallel to the first long edge of the rectangular plate, wherein the second member is substantially perpendicularly to the rectangular plate, and the long edge of the second member is coupled with the second surface of the rectangular plate proximate and parallel to the second long edge of the rectangular plate, wherein at the first member and second member each define an attachment hole configured to accept a fastener, installing the fall protection anchor on a primary framing member having a width that is sized to fit between the first member and second member by placing the fall protection anchor atop the primary framing member and inserting at least one fastener through at least one of the attachment holes into the primary framing member.

9. The method of installing a fall protection anchor system on a wood-framed building of claim 8, further comprising providing a plurality of attachment holes in each of the first member and second member, and inserting fasteners through the attachment holes and into the primary framing member.

10. The method of installing a fall protection anchor system on a wood-framed building of claim 8, further comprising:

attaching a first blocking perpendicular to the primary framing member proximate to the first short edge of the first member, attaching a second blocking perpendicular to the primary framing member proximate to the second short edge of the first member, attaching the first blocking and second blocking to a first roof joist that runs parallel to the primary framing member, attaching a third blocking perpendicular to the primary framing member proximate to the first short edge of the second member, attaching a fourth blocking perpendicular to the primary framing member proximate to the second short edge of the second member, and attaching the third blocking and fourth blocking to a second roof joist that runs parallel to the primary framing member.

11. The method of installing a fall protection anchor system on a wood-framed building of claim 10, further comprising:

attaching a first construction strapping to and along a length of the first blocking and along a length of the third blocking, and attaching a second construction strapping to and along a length of the second blocking and a length of the fourth blocking.

12. The method of installing a fall protection anchor system on a wood-framed building of claim 10, further comprising:

attaching a fifth blocking to the first roof joist and a third roof joist, attaching a sixth blocking to the third roof joist and a fourth roof joist, attaching a seventh blocking to the second roof joist and a fifth roof joist, and attaching an eighth blocking to the fifth roof joist and a sixth roof joist, wherein the first blocking, the fifth blocking, the sixth blocking, the seventh blocking, and the eighth blocking are all substantially collinear and substantially perpendicular to the primary framing member and all of the roof joists therebetween.

13. The method of installing a fall protection anchor system on a wood-framed building of claim 12, further comprising attaching construction strapping to and along a length of the first blocking, a length of the third blocking, a length of the fifth blocking, a length of the sixth blocking, a length of the seventh blocking, and a length of the eighth blocking.

14. The method of installing a fall protection anchor system on a wood-framed building of claim 13, further comprising extending the construction strapping to at least one vertical framing support, and attaching the construction strapping to the vertical framing support.

15. The method of installing a fall protection anchor system on a wood-framed building of claim 12, further comprising attaching roof sheathing covering to the primary framing member and all of the blocking.

16. The fall protection anchor system for a wood-framed building of claim 3, wherein at least one of the plurality of fasteners is inserted through at least one of the plurality of attachment holes and into the primary framing member.

17. The fall protection anchor system for a wood-framed building of claim 6, wherein the fall protection anchor system is configured for placement in between a first construction strapping and a second construction strapping, wherein the first construction strapping is attached to and along a length of the first blocking and a length of the third blocking, and the second construction strapping is attached to and along the length of the second blocking and the fourth blocking.

18. The fall protection anchor system for a wood-framed building of claim 7, wherein the fall protection anchor system is configured for placement in between a first construction strapping and a second construction strapping, wherein the first construction strapping is located atop the roof sheathing and attached via fasteners through the roof sheathing to the first blocking and the third blocking along their respective lengths, and the second construction strapping is located atop the roof sheathing and attached via fasteners through the sheathing to the second blocking and the fourth blocking along their respective lengths.

* * * * *